US012006777B2

(12) United States Patent
Zhang et al.

(10) Patent No.: US 12,006,777 B2
(45) Date of Patent: Jun. 11, 2024

(54) MULTIPLE SWIVELS AND ROTATION MOTOR SYSTEM

(71) Applicant: Landmark Graphics Corporation, Houston, TX (US)

(72) Inventors: Yuan Zhang, Missouri City, TX (US); Robello Samuel, Cypress, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 17/388,869

(22) Filed: Jul. 29, 2021

(65) Prior Publication Data

US 2023/0029884 A1 Feb. 2, 2023

(51) Int. Cl.
*E21B 17/05* (2006.01)
*E21B 4/16* (2006.01)

(52) U.S. Cl.
CPC ..... *E21B 17/05* (2013.01); *E21B 4/16* (2013.01)

(58) Field of Classification Search
CPC ..... E21B 17/05; E21B 4/16
See application file for complete search history.

(56) References Cited

U.S. PATENT DOCUMENTS 4,890,681 A 1/1990 Skelly
2006/0157253 A1 7/2006 Robichaux et al.
2013/0300570 A1* 11/2013 Cooper ..... G01V 5/12 340/854.4
2014/0169988 A1* 6/2014 Pesek ..... F04B 47/02 417/53
2014/0370995 A1* 12/2014 Collins ..... F04C 13/008 464/138
2015/0132604 A1* 5/2015 Sue ..... C25D 5/18 205/180
2015/0337604 A1 11/2015 Archuleta
2015/0337652 A1* 11/2015 Rodney ..... E21B 47/16 367/82
2016/0312574 A1 10/2016 Moffitt
2017/0044843 A1* 2/2017 Hanton ..... E21B 31/005
(Continued)

FOREIGN PATENT DOCUMENTS

AT 411446 T 10/2008
BR 112019000708 A2 5/2019
(Continued)

*Primary Examiner* — Nicole Coy
*Assistant Examiner* — Nicholas D Wlodarski
(74) *Attorney, Agent, or Firm* — Michael Jenney; Parker Justiss, P.C.

(57) ABSTRACT

The disclosure presents apparatuses and systems to reduce drag and friction forces on a drill string located downhole a borehole. The drill string can have two or more movement isolators to allow a movement sensitive tool to be movement isolated from other portions of the drill string that have powered movement. The other drill string portions can be powered by a surface equipment or by a downhole movement motor attached to the drill string, such as a rotational mud motor, an agitator, a jar motor, or a rotary steerable. Portions of the drill string located further downhole than the movement sensitive tool can utilize a movement motor attached to the drill string to provide movement to reduce drag and friction force where the movement isolators can reduce the movement force experienced by the movement sensitive tool.

20 Claims, 4 Drawing Sheets

(56) References Cited

U.S. PATENT DOCUMENTS

| | | | | |
|---|---|---|---|---|
| 2017/0191333 | A1 | 7/2017 | Lewis et al. | |
| 2017/0370151 | A1* | 12/2017 | Banirazi-Motlagh ..... | E21B 7/04 |
| 2018/0016844 | A1 | 1/2018 | Peters | |
| 2018/0202240 | A1 | 7/2018 | Chau et al. | |
| 2019/0316444 | A1* | 10/2019 | Entchev ..... | E21B 4/02 |

FOREIGN PATENT DOCUMENTS

| | | | |
|---|---|---|---|
| CA | 2605260 | A1 | 7/1998 |
| EP | 1840322 | A1 | 10/2007 |
| JP | H0671587 | A | 3/1994 |
| JP | 2837086 | B2 | 12/1998 |
| RU | 2012123304 | A | 12/2013 |
| WO | 2009021037 | A2 | 2/2009 |
| WO | 2020205138 | A1 | 10/2020 |

* cited by examiner

MULTIPLE SWIVELS AND ROTATION MOTOR SYSTEM

TECHNICAL FIELD

This application is directed, in general, to improving borehole operation efficiency and, more specifically, to reducing friction forces on a drill string located in a borehole.

BACKGROUND

In developing a borehole, such as when drilling operations are being conducted, the drill string, e.g., pipe, can experience a friction force against fluid or mud in the borehole, or against casing or the surrounding subterranean formations. The friction forces can cause a reduction of operational efficiency of the borehole and an increase in cost of operation of the borehole. The drill string can be rotated to reduce the drag force or friction force. A swivel segment can be included as part of the drill string so that certain tools can be isolated from the rotation movement. The length of the drill string lower than the swivel segment will be isolated. A better solution to isolate sensitive tools would be beneficial.

SUMMARY

In one aspects, an apparatus is disclosed. In one embodiment, the apparatus includes (1) a first drill string portion comprising one or more of a first set of drill pipe segments, first sensors, first tools, or first movement motors, wherein a first uphole longitudinal end of the first drill string portion is attached a surface equipment and the first drill string portion is inserted in a borehole, (2) a first movement isolator, attached to a first downhole longitudinal end of the first drill string portion, operable to isolate movement from the first drill string portion, (3) a second drill string portion, comprising one or more of a second set of drill pipe segments, second sensors, second tools, or second movement motors, wherein a second uphole longitudinal end of the second drill string portion is attached to the first movement isolator, and (4) a second movement isolator, attached to a second downhole longitudinal end of the second drill string portion and a third uphole longitudinal end of a third drill string portion, operable to isolate movement from the second drill string portion and the third drill string portion.

In a second aspects, a system is disclosed. In one embodiment, the system includes (1) a set of drill string portions, wherein each drill string portion in the set of drill string portions can have one or more drill pipe segments, tools, sensors, or movement motors, where the set of drill string portions includes at least three drill string portions, and (2) a set of movement isolators, wherein each movement isolator in the set of movement isolators is capable of isolating at least a portion of movement from an adjoining drill string portion, where one or more movement isolators from the set of movement isolators is attached longitudinally to an uphole longitudinal end of one drill string portion of the set of drill string portions and attached longitudinally to a downhole longitudinal end of a second drill string portion of the set of drill string portions.

In a third aspect, a method is disclosed. In one embodiment, the method includes (1) attaching a movement motor to a drill string, wherein the drill string is inserted into a borehole, (2) attaching a first movement isolator to the drill string, wherein there is a first set of zero or more drill pipe segments separating the movement motor and the first movement isolator, (3) attaching a movement sensitive tool to the drill string, wherein there is a second set of zero or more drill pipe segments separating the first movement isolator and the movement sensitive tool, and (4) attaching a second movement isolator to the drill string, wherein there is a third set of zero or more drill pipe segments separating the second movement isolator and the movement sensitive tool.

BRIEF DESCRIPTION

Reference is now made to the following descriptions taken in conjunction with the accompanying drawings, in which.

DETAILED DESCRIPTION

Figure 1:
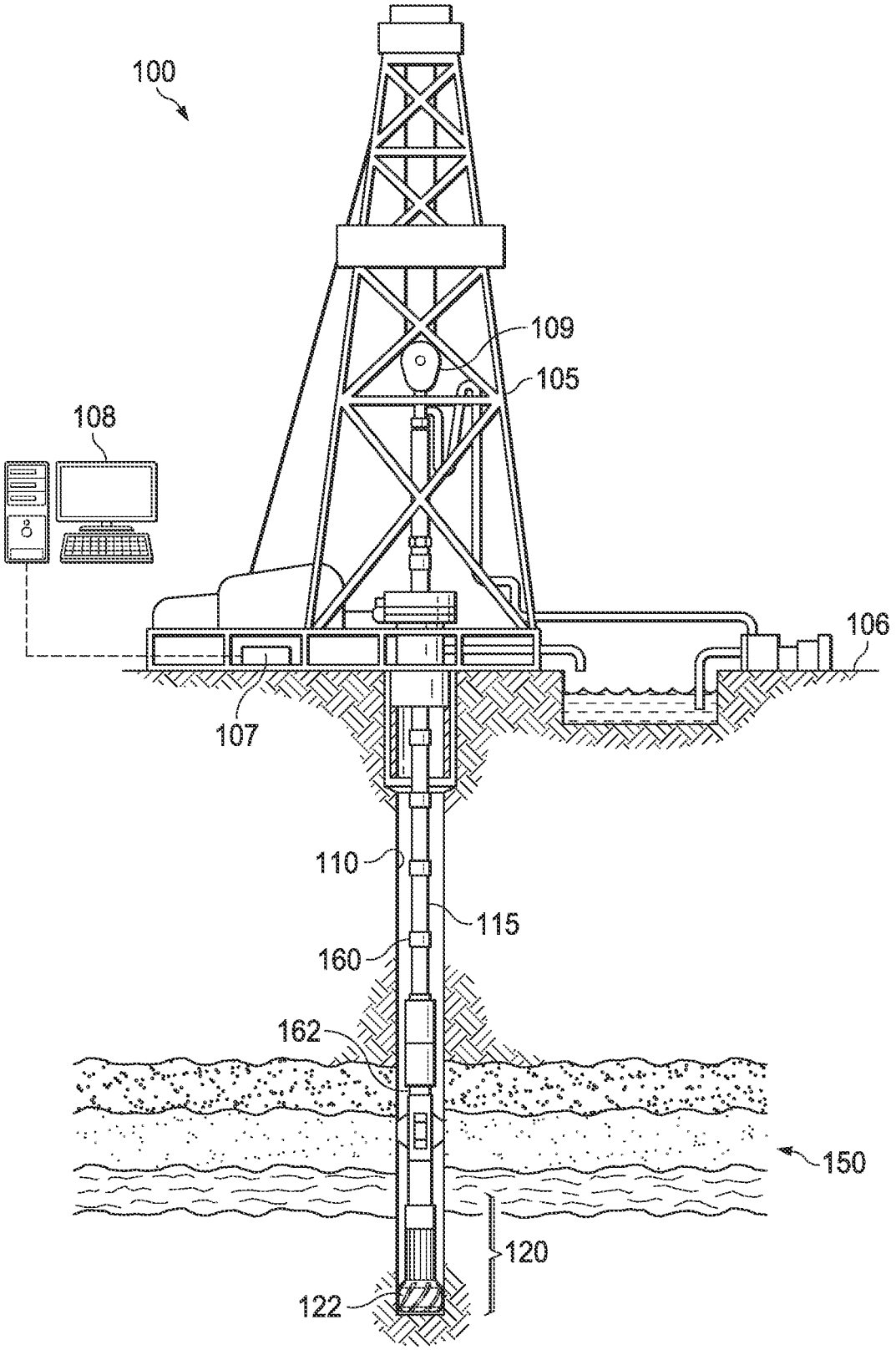
FIG. 1 is an illustration of a diagram of an example drilling borehole system with multiple movement isolators.

When developing a borehole, multiple types of borehole operations can be employed, such as drilling, trip in of a drill string, trip out of a drill string (i.e., drill pipe operations), extraction, and other borehole operations. Borehole operations can be affected by friction and drag forces in the borehole between the drill string and borehole fluids, borehole muds, borehole casing, subterranean formations, or accumulation of borehole material, e.g., cuttings or subterranean formation material. The friction and drag affects can be in one or more portions of the borehole. For example, a drilling fluid can accumulate cuttings and thereby increase the friction force against a drill string, or the drill string can experience friction against a casing or subterranean formation, such as in a bend or dogleg portion of the borehole. A borehole can be developed for hydrocarbon production purposes, scientific purposes, research purposes, or for other purposes that have operations occurring within a borehole.

A conventional method to reduce the friction experienced by the drill string, and the tools attached to the drill string, is to rotate the drill string, which can be powered at the wellhead, using surface equipment, or at another location along the drill string using a movement motor. There can be tools that are attached to the drill string or are part of a segment of drill pipe that is attached to the drill string that are sensitive to the rotation. These tools can have better performance, or have operational requirements, to be relatively stationery rather than rotating. In order to accommodate these tools, a swivel, or other type of movement isolator, can be added to the drill string to isolate a lower part of the drill string from the rotational force. The downhole length of the drill string from the movement isolator and extending further downhole to the downhole end of the drill string can be isolated. This can lead to an inefficiency as only a portion of the downhole length may need to be isolated, and other portions can be allowed to rotate to reduce friction experienced along those length portions.

This disclosure presents apparatuses and systems to utilize more than one movement isolator, e.g., swivel or other type of movement isolator, along the downhole length of the drill string and to utilize a movement motor in an otherwise isolated section of the drill string. The movement motor can be, for example, a rotational mud motor, an agitator motor, or other motor types. In some aspects, the movement motor can be two or more movement motors or a combination of different movement motors. The use of more than one movement isolator can allow one or more tools to remain rotationally stationery, while allowing other portions of the drill string to move to reduce friction and drag forces experienced by the drill string.

The use of multiple movement isolators can be used to separate the drill string into multiple portions, e.g., stages or sections. Each portion can include one or more tools, such as an agitator, mud motor, jars, rotary steerables, and other downhole tools. Various combinations of these tools can be used. Having multiple portions can allow each portion to be movable (such as a rotation movement, an axial agitation movement, a rotary steerable movement, a jarring movement, or other movement types) separately by installing a movement motor in that portion. In aspects where more than one movement motor is included, there can be one or more movement types in that portion of the drill string. The control of the rotation portion of the drill string can be implemented with higher efficiency to maximize the movement along the drill string length, thereby reducing the drag and friction forces experienced along the drill string length. Operational plans can be improved by enabling more control over the movement type and the amount, e.g., intensity, of movement along each portion of the drill string, as separated by the movement isolator.

In some aspects, the drilling operations can be directed by a drilling controller, a well site controller, a bottom hole assembly (BHA), a proximate computing system, an edge computing system, or a distant computing system, for example, a cloud environment, a data center, a server, a laptop, a smartphone, or other computing systems. In some aspects, a portion of the disclosure can be performed by downhole tools, such as by a drilling assembly or a reservoir description tool, for example, a downhole tool can direct the operation of a movement motor along the drill string.

Turning now to the figures, FIG. 1 is an illustration of a diagram of an example drilling borehole system 100 with multiple movement isolators. Drilling borehole system 100 can be a drilling system, a logging while drilling (LWD) system, a measuring while drilling (MWD) system, a seismic while drilling (SWD) system, a telemetry while drilling (TWD) system, and other hydrocarbon well systems, such as a relief well, an intercept well, a well undergoing an automatic drilling condition, or a system using a completion string. Drilling borehole system 100 includes a derrick 105, a well site controller 107, and a computing system 108. Well site controller 107 includes a processor and a memory and is configured to direct operation of drilling borehole system 100. In some aspects, well site controller 107 can be a drilling controller. Derrick 105 is located at a surface 106.

Derrick 105 includes a traveling block 109 that includes a drill string hook. Traveling block 109 includes surface sensors to collect data on hook-load and torque experienced at traveling block 109. Extending below derrick 105 is a borehole 110, e.g., an active borehole, with downhole tools 120 at the end of a drill string 115. Downhole tools 120 can include various downhole tools and BHA, such as drilling bit 122. Other components of downhole tools 120 can be present, such as a local power supply (e.g., generators, batteries, or capacitors), telemetry systems, downhole sensors, transceivers, and control systems.

Borehole 110 is surrounded by subterranean formation 150. Well site controller 107 or computing system 108 which can be communicatively coupled to well site controller 107, can be utilized to communicate with downhole tools 120, such as sending and receiving telemetry, data, drilling sensor data, instructions, and other information, including collected or measured parameters, cuttings and other material parameters, bed heights, weighting parameters, location within the borehole, a cuttings density, a cuttings load, a cuttings shape, a cuttings size, a deviation, a drill string rotation rate, a drill string size, a flow regime, a mud composition, a drilling fluid composition, a hole size, a mud density, a mud rheology, a mud velocity, a pipe eccentricity, a subterranean formation composition, or other input parameters.

Computing system 108 can be proximate well site controller 107 or be distant, such as in a cloud environment, a data center, a lab, or a corporate office. Computing system 108 can be a laptop, a smartphone, a PDA, a server, a desktop computer, a cloud computing system, an edge computing system, other computing systems, or a combination thereof, that are operable to perform the processes and methods described herein. Well site operators, engineers, and other personnel can send and receive data, instructions, measurements, and other information by various conventional means with computing system 108 or well site controller 107.

A movement isolator 160 and a movement isolator 162 are located as part of drill string 115 and can isolate a portion of drill string 115 from movement. For example, the length of drill string 115 above (e.g., uphole) of movement isolator 160 can rotate using a force generated at traveling block 109, e.g., the wellhead. The length of drill string 115 between movement isolator 160 and movement isolator 162 can be isolated from movement and include one or more tools that operate more efficiently when there is no rotational movement. The length of drill string 115 that is lower (e.g., downhole), than movement isolator 162 can have a movement motor to cause movement of this portion of the drill string. The movement can be generated by a rotational motor, such as a mud motor, by an axial agitator, or another movement motor.

FIG. 1 depicts an onshore operation. Those skilled in the art will understand that the disclosure is equally well suited for use in offshore operations. FIG. 1 depicts a specific borehole configuration, those skilled in the art will understand that the disclosure is equally well suited for use in boreholes having other orientations including vertical boreholes, horizontal boreholes, slanted boreholes, multilateral boreholes, and other borehole types.

Figure 2:
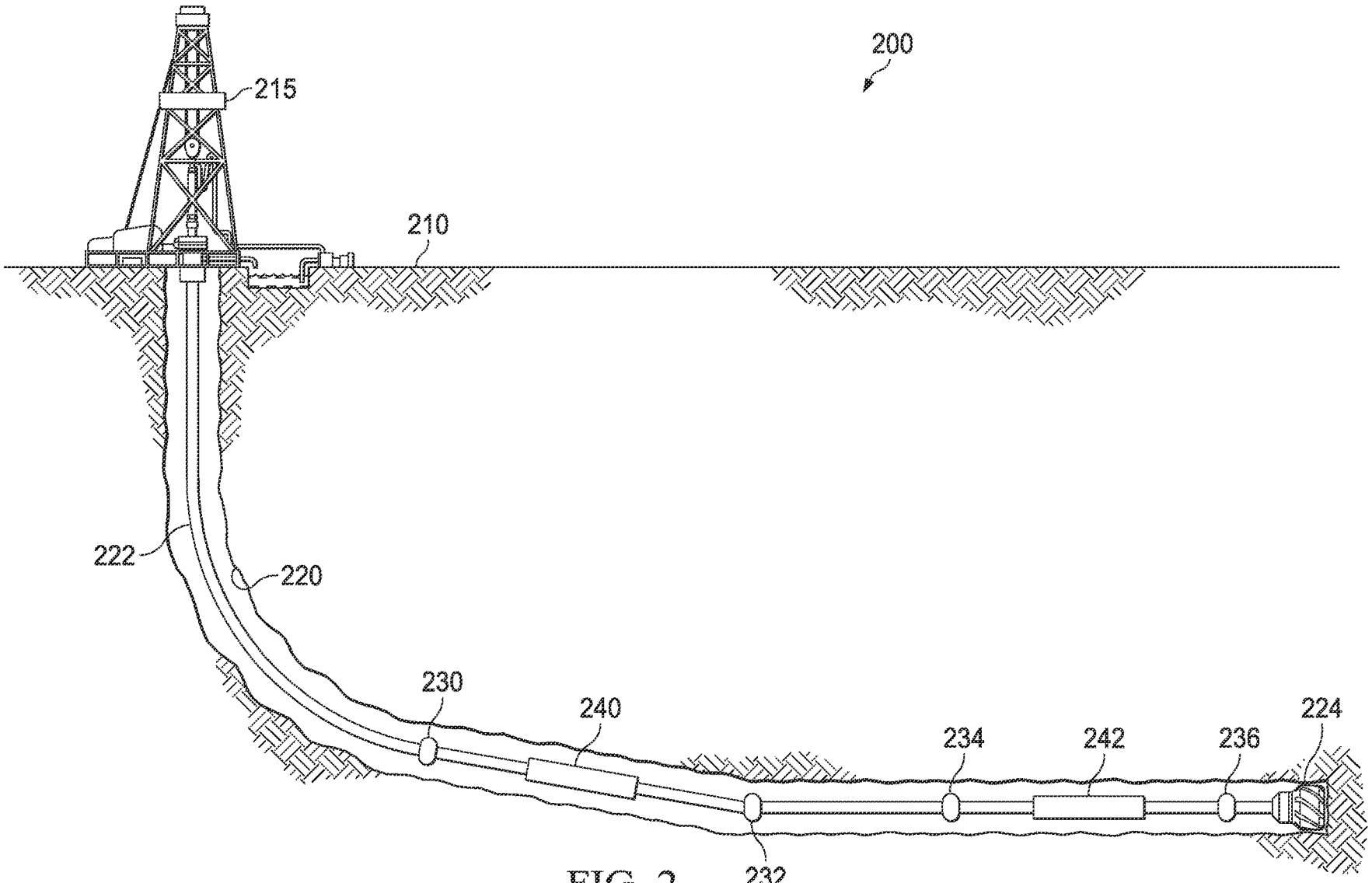
FIG. 2 is an illustration of a diagram of an example movement isolator system with rotation motors.

FIG. 2 is an illustration of a diagram of an example movement isolator system 200 with rotation motors. As drilling operations progress, cuttings, mud, including additives to the mud, and other borehole material can settle around the drill string and cause additional drag or friction on the drill string. Rotating the drill string can reduce the drag or friction. Movement isolator system 200 has a surface equipment 215 at a surface 210. Extending below surface 210 is a borehole 220. Inserted in borehole 220 is a drill string 222.

Drill string 222 is separated into portions. A first drill string portion is a length of drill string 222 from surface equipment 215 to a movement isolator 230. The first drill string portion can rotate as surface equipment 215 applies a rotation force on drill string 222, e.g., rotation force applied at the wellhead. Movement isolator 230 isolates the remaining length of drill string 222 from the rotation force.

A second drill string portion is a length of drill string 222 from movement isolator 230 to movement isolator 232. The second drill string section has a movement motor 240. Movement motor 240, for example, a mud rotation motor, an agitator, or other movement type motor, can be used to control an intensity of movement, a rate of movement, an amount of torque to apply, an interval of time to apply the movement force, and other movement related parameters. Movement motor 240 can be controlled by a movement controller along the second drill string portion, by a movement controller located with other downhole tools in other portions of drill string 222, or by a movement controller located at or proximate surface equipment 215, such as a well site controller, a drilling controller, a computing system, or other types of controllers.

A third drill string portion is a length of drill string 222 from movement isolator 232 to movement isolator 234. In this example, the third drill string portion is intended to be as stationery as possible. Tools, such as a centralizer, can be located here where the non-movement or limited movement can aide in the tool efficiency or protect the tool from damage. A fourth drill string portion is a length of drill string 222 from movement isolator 234 to movement isolator 236. Similar to the second drill string portion, the fourth drill string portion has a movement motor 242. Movement motor 242 can apply the same, the similar, or different movement force types and movement related parameters as used by movement motor 240. Movement motor 242 can be controlled the by the same or different controllers from movement motor 242.

A fifth drill string portion is a length of drill string 222 from movement isolator 236 to the downhole end of drill string 222. At the end of drill string 222 can be downhole tools 224. For example, downhole tools 224 can be a drill bit assembly, a bottom hole assembly (BHA), a reservoir description tool (RDT), other tools, other components (such as power sources, communication devices, controllers, processors, memory, sensors) or various combinations thereof.

Movement isolator 230, movement isolator 232, movement isolator 234, and movement isolator 236 can be in a set of movement isolators of movement isolator system 200. Each movement isolator in the set of movement isolators can be more than one movement isolator, for example, a swivel and an agitator isolator. The first drill string portion, the second drill string portion, the third drill string portion, the fourth drill string portion, and the fifth drill string portion can be in a set of drill string portions of movement isolator system 200. Each drill string portion in the set of drill string portions can have one or more drill pipe segments, tools, sensors, or movement motors. Each drill string portion in the set of drill string portions can include zero or more drill pipe segments or one or more drill string portions attached longitudinally.

Figure 3:
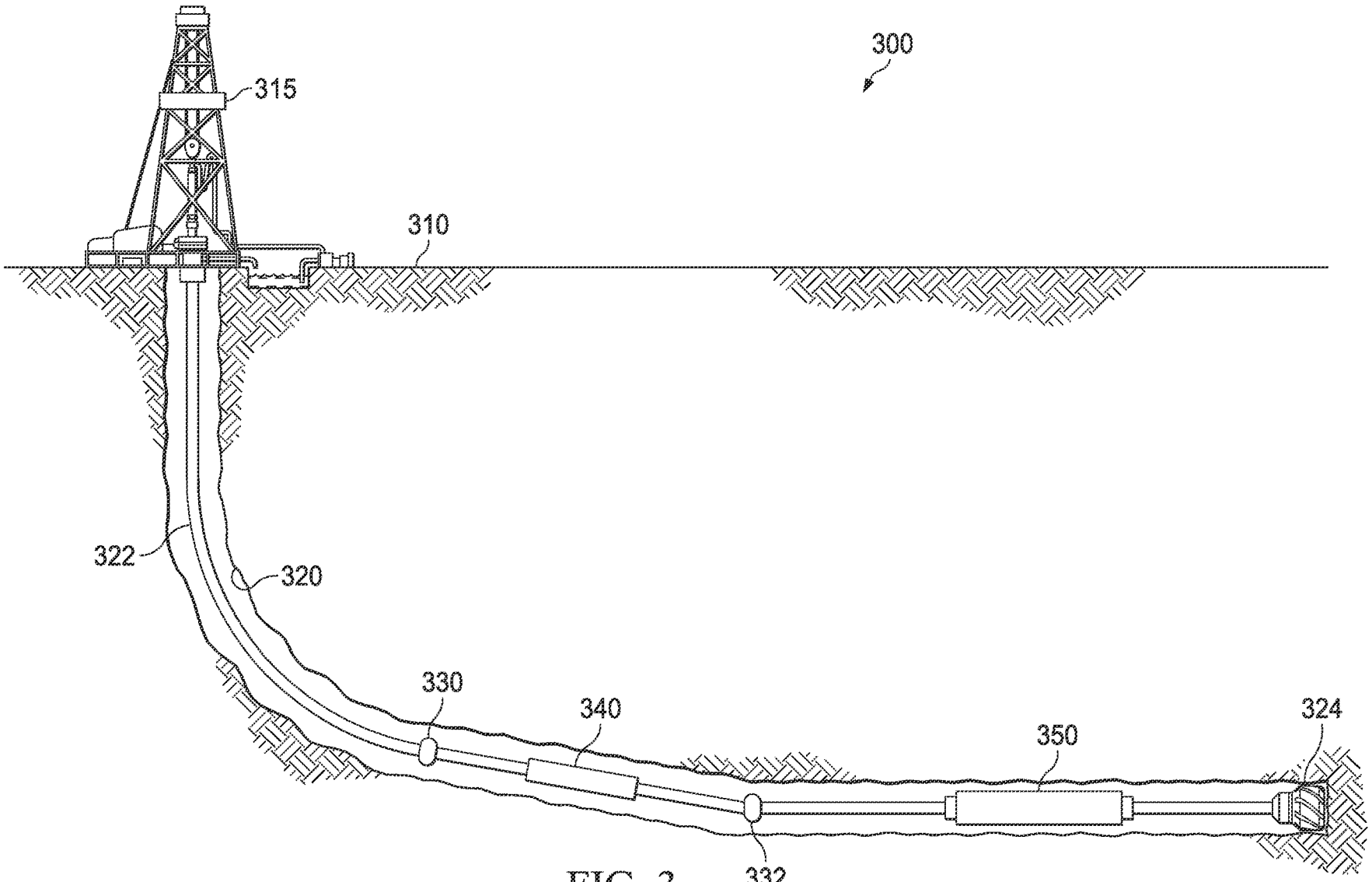
FIG. 3 is an illustration of a diagram of an example movement isolator system with an agitator.

FIG. 3 is an illustration of a diagram of an example movement isolator system 300 with an agitator. Movement isolator system 300 is similar to movement isolator system 200 while showing an agitator type of movement motor. Movement isolator system 300 has a surface equipment 315 at a surface 310. Extending below surface 310 is a borehole 320. Inserted in borehole 320 is a drill string 322.

Drill string 322 is separated into several portions. A first drill string portion is a length of drill string 322 from surface equipment 315 to a movement isolator 330. The first drill string portion can rotate as surface equipment 315 applies a rotation force on drill string 322, e.g., rotation force applied at the wellhead. Movement isolator 330 isolates the remaining length of drill string 322 from the rotation force.

A second drill string portion is a length of drill string 322 from movement isolator 330 to movement isolator 332. The second drill string portion has a movement motor 340. Movement motor 340, for example, a mud rotation motor, an agitator, or other movement type motor, can be used to control an intensity of movement, a rate of movement, an amount of torque to apply, an interval of time to apply the movement force, and other movement related parameters. Movement motor 340 can be controlled by a movement controller along the second drill string portion, by a movement controller located with other downhole tools in other sections of drill string 322, or by a movement controller located at or proximate surface equipment 315, such as a well site controller, a drilling controller, a computing system, or other types of controllers.

A third drill string portion is a length of drill string 322 from movement isolator 332 to the downhole end of drill string 322. At the end of drill string 322 can be downhole tools 324. For example, downhole tools 324 can be a drill bit assembly, a BHA, an RDT, other tools, other components (such as power sources, communication devices, controllers, processors, memory, sensors) or various combinations thereof. The third drill string portion includes an agitator 350. Agitator 350 can exert a force, e.g., a vibration force, in selected vectors, such as an axial oriented force or a radial oriented force. Downhole tools that are sensitive to rotation and not sensitive to the agitation force can be located in this section of drill string 322. The agitation force, similar to the rotation force, can reduce the drag forces and friction forces experienced by drill string 322 during operations.

Movement isolator 330 and movement isolator 332 can be in a set of movement isolators of movement isolator system 300. Each movement isolator in the set of movement isolators can be more than one movement isolator, for example, a swivel and an agitator isolator. The first drill string portion, the second drill string portion, and the third drill string portion can be in a set of drill string portions of movement isolator system 300. Each drill string portion in the set of drill string portions can have one or more drill pipe segments, tools, sensors, or movement motors. Each drill string portion in the set of drill string portions can include zero or more drill pipe segments or one or more drill string portions attached longitudinally.

FIGS. 2 and 3 are example implementations of multiple movement isolators and at least one movement motor. Other combinations of movement isolators and movement motors can be utilized. In some aspects, in systems that use more than one movement motor, the movement isolators can be utilized to prevent sympathetic movement damage (such as vibrations) when the work range of the movement motors (such as agitators) overlap over portions of the drill string. In some aspects, movement motors in a current portion of the drill string can be used to partially counteract movement forces, e.g., partially counteracting or cancelling movement, of distant movement motors in another portion (e.g., distant drill string portion, a proximate drill string portion, or a different drill string portion) of the drill string to reduce movement forces affecting tools in the current portion.

Figure 4:
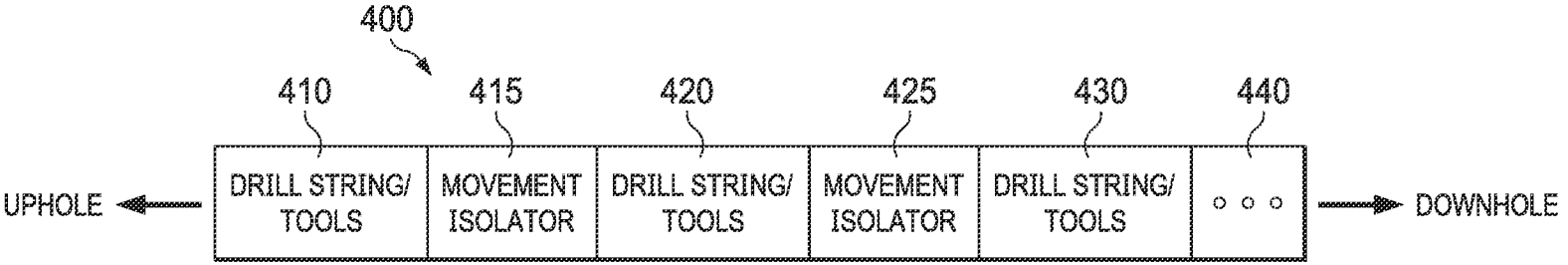
FIG. 4 is an illustration of a block diagram of an example drill string apparatus with movement isolators.

FIG. 4 is an illustration of a block diagram of an example drill string apparatus 400 with movement isolators. Drill string apparatus 400 can be used to assemble various combinations of movement isolators and movement motors. For example, drill string apparatus 400 can be utilized to implement movement isolator system 200 or movement isolator system 300. Drill string apparatus 400 can be used to implement method 500 of FIG. 5.

Drill string apparatus 400 has first drill string portion 410 that can include tools and sensors in a portion or a whole of first drill string portion 410. On one longitudinal end, e.g., the uphole end, of first drill string portion 410 can be surface equipment, such as a drilling rig, or additional drill string portions. On the other longitudinal end, e.g., the downhole end, of first drill string portion 410 is a movement isolator 415. Movement isolator 415 is capable of isolating at least a portion of movement from the adjoining drill string portions. On the downhole longitudinal end of movement isolator 415 is a second drill string portion 420. On the downhole longitudinal end of second drill string portion 420 is a movement isolator 425. Movement isolator 425 is capable of isolating at least a portion of movement from the adjoining drill string portions.

In this example apparatus, second drill string portion 420 is isolated in respect to movement and therefore can include motion sensitive equipment, such as a centralizer. In some aspects, second drill string portion 420 can include a movement motor. For example, an agitator can be included when the equipment used in second drill string portion 420 can continue to operate within operational plan specifications when the agitator is operating.

On the downhole longitudinal end of movement isolator 425 is a third drill string portion 430. In some aspects, third drill string portion 430 can include a movement motor, such as a rotational mud motor, an agitator, or other type of movement motor. In some aspects, third drill string portion 430 can include a BHA, a drilling assembly, or other end of drill string equipment. In some aspects, there can be additional movement isolators and drill string portions as shown by ellipsis 440.

First drill string portion 410, second drill string portion 420, and third drill string portion 430 can be one or more drill pipe segments, tools, sensors, connectors, collars, and other drill string equipment. First drill string portion 410, second drill string portion 420, and third drill string portion 430 can be of the same, different, or partially the same lengths and can include the same, different, or partially the same tools, sensors, equipment, and movement motors. For example, each drill string portion can include its own set of tools, such as one or more of agitators, mud motors, jar motors, rotary steerables, other movement motors, or other tools, in various combinations. Movement isolator 415 and movement isolator 425 can be one or more of a swivel or other type of movement isolator. A movement motor, as described above, can be one or more mud motors, agitators, other types of motors, or various combinations thereof. Additional elements of drill string apparatus 400 can be attached in various combinations to implement longer drill string systems.

Figure 5:
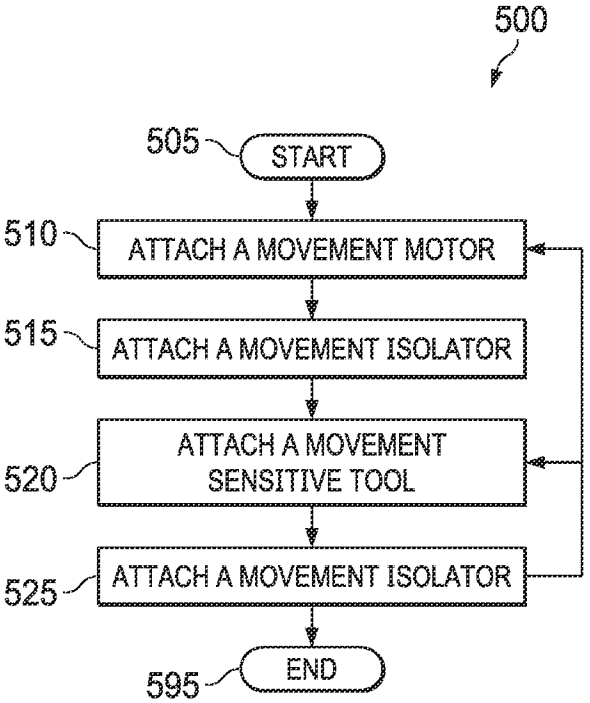
FIG. 5 is an illustration of a flow diagram of an example method using more than one movement isolator on a drill string.

FIG. 5 is an illustration of a flow diagram of an example method 500 using more than one movement isolator on a drill string. Method 500 can be performed, for example, by engineers assembling drill pipe segments at a borehole. Method 500 encapsulates the steps for implementing drill string apparatus 400 where the drill string is assembled from the downhole longitudinal end toward the uphole longitudinal end.

Method 500 starts at a step 505 and proceeds to a step 510. In step 510, a movement motor can be attached to the drill string. The drill string can have one or more drill pipe segments and other equipment, such as tools, sensors, BHA, drilling assembly, or other end of drill string tools. The movement motor can provide movement to this portion of the drill string to reduce the drag and friction forces experienced by this portion of the drill string.

In a step 515, a movement isolator can be attached to the drill string, such as a swivel. The movement isolator is capable of isolating at least a portion of movement from the adjoining drill string portions. In a step 520, in the next portion of the drill string, movement sensitive tools can be attached along with other tools, sensors, and drill pipe segments. In a step 525, a movement isolator can be attached to the drill string to reduce movement forces to implement a movement isolation of the equipment attached in step 520. The movement isolator is capable of isolating at least a portion of movement from the adjoining drill string portions.

Proceeding from step 525, additional drill pipe segments, tools, equipment, and sensors can be added, method 500 can proceed to step 510, or 520, or method 500 can end at a step 595. The determination of the step to proceed to can depend on the drill string design as determined by the drilling operation plan.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each of the aspects disclosed in the SUMMARY can have one or more of the following additional elements in combination. Element 1: wherein the first movement isolator or the second movement isolator is a swivel. Element 2: wherein the first movement isolator or the second movement isolator is more than one movement isolator. Element 3: wherein the second drill string portion includes a movement sensitive tool. Element 4: wherein the third drill string portion includes a third movement motor. Element 5: wherein the third movement motor is a rotational mud motor, an agitator, a jar motor, or a rotary steerable motor. Element 6: wherein the first movement motors or the second movement motors are further capable of partially counteracting movement caused by a distant movement motor located in a different drill string portion. Element 7: wherein the first movement motors or the second movement motors are two or more movement motors. Element 8: further comprising one or more additional drill string portions and one or more additional movement isolators. Element 9: wherein each movement isolator in the set of movement isolators is a swivel. Element 10: wherein one drill string portion of the set of drill string portions includes a movement sensitive tool. Element 11: wherein the movement motors are one or more of a rotational mud motor, an agitator, a jar motor, or a rotary steerable motor. Element 12: wherein at least one of the at least three drill string portions includes more than one movement motor. Element 13: wherein the movement motors are further capable of counteracting movement caused by a distant movement motor located in a different drill string portion. Element 14: wherein additional movement isolators, additional movement motors, and additional drill pipe segments are attached to the drill string. Element 15: wherein the movement motor is capable to partially counteract movement caused by a distant movement motor located in a different drill string portion. Element 16: wherein the movement motor is two or more movement motors. Element 17: wherein the first movement isolator or the second movement isolator is two or more movement isolators. Element 18: wherein the two or more movement isolators or different types of movement isolators.

What is claimed is:

1. An apparatus, comprising:

a first drill string portion comprising one or more of a first set of drill pipe segments, first sensors, or first downhole tools, wherein a first uphole longitudinal end of the first drill string portion is attached to surface equipment and the first drill string portion is inserted in a borehole;

a first movement isolator, attached to a first downhole longitudinal end of the first drill string portion, operable to isolate movement from the first drill string portion;

a second drill string portion, comprising one or more of a second set of drill pipe segments, second sensors, or second downhole tools wherein a second uphole longitudinal end of the second drill string portion is attached to the first movement isolator;

a second movement isolator, attached to a second downhole longitudinal end of the second drill string portion;

a third drill string portion comprising one or more of a third set of drill pipe segments, third downhole tools, or third sensors wherein a third uphole longitudinal end of the third drill string portion is attached to the second movement isolator, which is operable to isolate movement from the second drill string portion and the third drill string portion;

a third movement isolator, attached to a third downhole longitudinal end of the third drill string portion; and an end of drill string portion comprising a drill bit assembly, wherein the third movement isolator is operable to isolate movement from the end drill string portion and the third drill string portion, and one of the first, second, or third drill string portions further include multiple movement devices capable of causing both axial movement and rotational movement of the one of the first, second, or third drill string portions, wherein a first one of the multiple movement devices is capable of causing the axial movement and at least another one of the multiple movement devices that is different than the first one is capable of causing the rotational movement.

2. The apparatus as recited in claim 1, wherein the first movement isolator or the second movement isolator is a swivel.

3. The apparatus as recited in claim 1, wherein the first movement isolator or the second movement isolator is more than one movement isolator.

4. The apparatus as recited in claim 1, wherein the second drill string portion and the third drill string portion include a movement sensitive tool.

5. The apparatus as recited in claim 1, wherein the at least one of the multiple movement devices capable of causing axial movement is an axial agitator.

6. The apparatus as recited in claim 5, wherein the at least another one of the multiple movement devices capable of causing rotational movement is a rotation motor.

7. The apparatus as recited in claim 1, wherein the multiple movement devices are further capable of partially counteracting movement caused by a distant movement motor located in a different drill string portion.

8. The apparatus as recited in claim 6, wherein the rotation motor is a mud motor.

9. The apparatus as recited in claim 1, further comprising one or more additional drill string portions and one or more additional movement isolators.

10. A system, comprising:

an end of drill string portion having a drill bit assembly;

an end drill string movement isolator attached to an uphill longitudinal end of the end of drill string portion;

a set of drill string portions attached to the end drill string movement isolator, wherein each drill string portion in the set of drill string portions has one or more drill pipe segments, downhole tools, or sensors; and a set of movement isolators, where one or more movement isolators from the set of movement isolators is attached longitudinally to an uphole longitudinal end of one drill string portion of the set of drill string portions and attached longitudinally to a downhole longitudinal end of a different drill string portion of the set of drill string portions, wherein at least one drill string portion of the set of drill string portions further includes an axial movement device capable of causing axial movement of the at least one drill string portion and a rotational movement device capable of causing rotational movement of the at least one drill string portion, and each movement isolator in the set of movement isolators is capable of isolating at least a portion of movement from an attached drill string portion.

11. The system as recited in claim 10, wherein the set of movement isolators includes a swivel.

12. The system as recited in claim 10, wherein one drill string portion of the set of drill string portions includes a movement sensitive tool.

13. The system as recited in claim 10, wherein the axial movement device is an axial agitator.

14. The system as recited in claim 10, wherein the rotational movement device is a rotation motor.

15. The system as recited in claim 10, wherein at least one of the axial movement device or the rotational movement device is capable of counteracting movement caused by a distant movement motor located in a different drill string portion.

16. A method, comprising:

attaching a first movement device and a second movement device to a drill string, wherein the drill string is inserted into a borehole and is attached to a drill bit assembly;

attaching a first movement isolator to the drill string;

attaching a movement sensitive tool to the drill string;

attaching a second movement isolator to the drill string; and attaching a third movement isolator to the drill string, wherein the first movement isolator is positioned between the drill bit assembly and the movement sensitive tool, the movement sensitive tool is positioned between the first movement isolator and the second movement isolator, and the first and second movement devices are positioned between the second movement isolator and the third movement isolator, wherein the first movement device causes axial movement of a portion of the drill string between the second and third movement isolators and the second movement device causes rotational movement of the portion of the drill string between the second and third movement isolators.

17. The method as recited in claim 16, wherein additional movement isolators and additional movement motors are attached to the drill string.

18. The method as recited in claim 16, wherein the first movement device or the second movement device is capable to partially counteract movement caused by at least one other movement device attached to the drill string.

19. The method as recited in claim 16, wherein the first movement device is an axial agitator and the second movement device is a rotation motor.

20. The method as recited in claim 16, wherein the first movement isolator or the second movement isolator is two or more movement isolators, wherein the two or more movement isolators are different types of movement isolators.

* * * * *